US005256857A

United States Patent [19]

Curhan et al.

[11] Patent Number: 5,256,857

[45] Date of Patent: Oct. 26, 1993

[54] FINNED PTC AIR HEATER ASSEMBLY FOR HEATING AN AUTOMOTIVE PASSENGER COMPARTMENT

[75] Inventors: Jeffrey A. Curhan, Medway; Daniel R. Pimentel, Seekonk; Peter G. Berg, Attleboro Falls, all of Mass.

[73] Assignee: Texas Instruments Incorporated, Dallas, Tex.

[21] Appl. No.: 571,379

[22] Filed: Aug. 22, 1990

[51] Int. Cl.[5] ..... H05B 1/02; H05B 3/14; H01C 7/02; F24H 3/04

[52] U.S. Cl. ..... 219/202; 219/505; 219/530; 219/540; 338/22 R; 392/347; 392/360; 392/379

[58] Field of Search ..... 219/505, 530, 540, 504, 219/202; 338/22 R; 392/347, 379, 360

[56] References Cited

U.S. PATENT DOCUMENTS 4,482,801 11/1984 Habata et al. ..... 219/540
4,963,716 10/1990 Van Dem Elst ..... 219/202

FOREIGN PATENT DOCUMENTS 0243077 10/1987 European Pat. Off. .
0350528 1/1990 European Pat. Off. .
53-125641 2/1978 Japan .
53-92933 3/1978 Japan .
2076270 8/1984 United Kingdom .

*Primary Examiner*—Anthony Bartis
*Attorney, Agent, or Firm*—Russell E. Baumann; René E. Grossman; Richard L. Donaldson

[57] ABSTRACT

A heater particularly adapted for use in automotive applications as a passenger compartment heater or the like has a housing with an opening and has a plurality of heat-exchanging fin members and self-regulating electrical resistance heater discs of positive temperature coefficient resistivity (PTC) disposed in the housing to heat air or other fluid which is passed through the housing opening in heat-transfer relation to the fin members. A thermally conductive grease is positioned between the PTC heater discs and fin members to enhance heat transfer. Springs resiliently position the fin members, grease and heater discs in thermally and electrically conductive relation to each other between terminals accessible from the housing exterior to retain the fin members, grease and heater discs engaged during thermal expansion and vibration for reliably energizing the heater discs to heat the fin members over a long service life.

6 Claims, 5 Drawing Sheets

FINNED PTC AIR HEATER ASSEMBLY FOR HEATING AN AUTOMOTIVE PASSENGER COMPARTMENT

BACKGROUND OF THE INVENTION

The field of the invention is that of heaters and the inventions relates more particularly to electrically operated heaters of economical and reliable construction adapted for use as automotive passenger compartment heaters or the like.

Recent trends toward automotive engines operating with greater efficiencies and lower heat rejection rates have progressively reduced the amount of "waste" heat from the vehicle engine which is available for use for heating the passenger compartment. At the same time there is a desire to reduce the compartment heat-up time and to increase passenger compartment temperature. Accordingly, the use of electrical resistance heaters energized from the vehicle power source has been proposed and such electrical resistance heaters using self-regulating heater discs or elements of positive temperature coefficient of resistivity to supplement the conventional hot-water-based heaters have been found to reduce compartment heat-up time and to increase steady state compartment temperature where desired. However, providing such resistance heaters with the reliability and efficiency to operate from the limited available power supply in an automotive vehicle over a long service life subjected to heavy vibrations and wide swings in temperature conditions tends to be expensive. It would be desirable if such a heater made with low cost, high efficiency heat-transfer materials could be provided with a structure which would be economical and convenient to manufacture, assembly and install and which would be efficient and reliable in use. It would also be desirable if such a heater could also be adapted for other fluid heating purposes in automotive applications.

BRIEF SUMMARY OF THE INVENTION

It is an object of the invention to provide a novel and improved heater for an automotive passenger compartment or the like; to provide such a heater which is inexpensive to manufacture and assemble; and to provide such a heater which is reliable and efficient in use.

Briefly described, the heater of the invention comprises a housing which has an opening extending through the housing so that air or other fluid can be passed through the housing by a fan or the like to be heated. A pair of terminals, one or more heat-exchanging fin members, and one or more self-regulating electrical resistance heater elements of positive temperature coefficient of resistivity having electrical contacts on opposite sides are disposed in the housing. Spring means resiliently position the fin members and heater elements in thermally and electrically conductive relation to each other between the terminals to be retained in the housing and to define an electrical circuit to direct current through the fin members and heater elements in a selected sequence for electrically energizing the heater elements to furnish heat to the fin members to heat the air or other fluid passed through the housing in heat-transfer relation to the fin members. The fin member typically embody baffle members and plates or the like secured together by soldering or brazing or by forming as extrusion. In one preferred embodiment, each fin member comprises a pair of flat metal strips or plates having a separate baffle member formed from a single metal sheet disposed between the plates to define a plurality of fluid or air flow passage portions through the fin member around the baffle portions of the baffle member. In that arrangement, the spring means resiliently bias the plates and baffle member into thermally and electrically conductive engagement with each other, and preferably compress baffle portions of the baffle member into a truss configuration for greater rigidity and strength, while retaining the fin member in the housing and to define a portion of the noted element energizing circuit. Preferably the fin members are arranged so that least selected ones of the fin members engage contacts on one side of just two of the heater elements, the spring means are located to resiliently bias those fin members to bear against those two heater element contacts with substantially equal force, that arrangement being repeated throughout the heater structure so that all of the heater element contacts are engaged with substantially the same force. With these structural features, the housing means including the spring means are adapted to be formed of strong, low cost materials for a long service life. The fin members comprise components of low cost shape adapted to be formed of low cost materials such as aluminum or the like to provide high thermal and electrical conductivity to achieve high operating efficiency in the heater. The electrical resistance heater elements, typical flat thin discs of square, round, triangular, or rectangular outline or the like, are also characterized by low cost structure adapted for volume production. In addition, the heater components are easily assembled with assurance they will be reliably retained in the housing in thermally and electrically conductive engagement with each other in the desired way over a long service life even though they are subjected to heavy vibration and to thermal expansion and contraction during wide temperature variations in automotive applications and even though low cost aluminum baffle members and the like used in the heater are subject to cold metal flow or creep or risk of other deformation over a long period of use.

In one preferred embodiment of the invention, a pair of housing members are disposed in spaced relation to each other and a pair of spring elements are secured across ends of the housing members to form a housing unit and to define a housing opening between the housing members and spring elements. A terminal plate is centrally disposed between the housing members with its ends extending in the direction of the housing members. A pair of fin members is disposed on each side of the terminal plate and a group of heater elements or discs is disposed between the pair of fin members on each side of the terminal plate. The spring elements and at least one housing member are formed of electrically conductive metal materials and an integral terminal portion is preferably bent out of that housing member. The spring elements bear against one fin member in each pair for positioning all of the fin members and heater discs in thermally and electrically conductive relation to each other to be retained in the housing unit and to define two circuit portions between the terminal plate and integral terminal in each of which one group of heater elements or discs is electrically energized between a pair of fin members. Preferably the spring elements have hooked ends detachably secured in slots at respective opposite ends of the housing members, the housing unit being adapted to snap together around the terminal plate, fin members and heater discs as stacked in the described arrangement. Preferably an insulator means is disposed between the conductive housing member or members and terminal plate and the adjacent fin members which are of opposite polarity. Preferably an insulator strip is disposed between the pair of fin members around the heater discs which are disposed therebetween, and preferably an electrically insulating substance of suitably high thermal conductivity such as a thermal grease is placed between the heater discs and adjacent members, preferably within apertures in the insulator strip to facilitate heat-transfer from the discs to the fin members, the metal contact means on the heater discs having asperities or an irregular or rough surface to electrically engage the adjacent fin members through the grease. Preferably the housing unit as described is disposed in a housing enclosure component of a thermally and electrically insulating material or the like having mounting bosses thereon to facilitate mounting of the heater in an automotive vehicle.

In another preferred embodiment of the invention, three fin members are arranged with two groups of heater discs disposed between adjacent pairs of the fin members, one terminal being connected to the central fin member and a second terminal being connected to the other two fin members. In another preferred embodiment, particularly adapted for use in preheating diesel engine intake air or the like to reduce diesel pollution emissions, the fin members are arranged to extend in a plurality of rows across the housing opening, the fin members in alternate rows being of different length. Preferably, for example, a fin member in a central row extends the entire length of the row and is secured in electrically insulating relation to a surrounding, electrically conductive housing means. Several fin members of shorter length are disposed in each adjacent row and just two heater discs are disposed between each of the shorter fin members and a portion of the larger fin member, separate spring elements being arranged between the housing and the respective shorter fin members to bias the fin members to bear against all of the heater disc contacts with substantially the same force. In another preferred embodiment, the spring means are secured to a support member and a housing strap which extends around a stack of fin members and heater discs as above described is secured to opposite ends of the spring support member to form the housing unit.

DESCRIPTION OF THE DRAWINGS

Other objects, advantages and details of the novel and improved heater of the invention appear in the following detailed description of preferred embodiments of the invention, the detailed description referring to the drawings in which.

DESCRIPTION OF THE PREFERRED EMBODIMENTS

Figure 5:
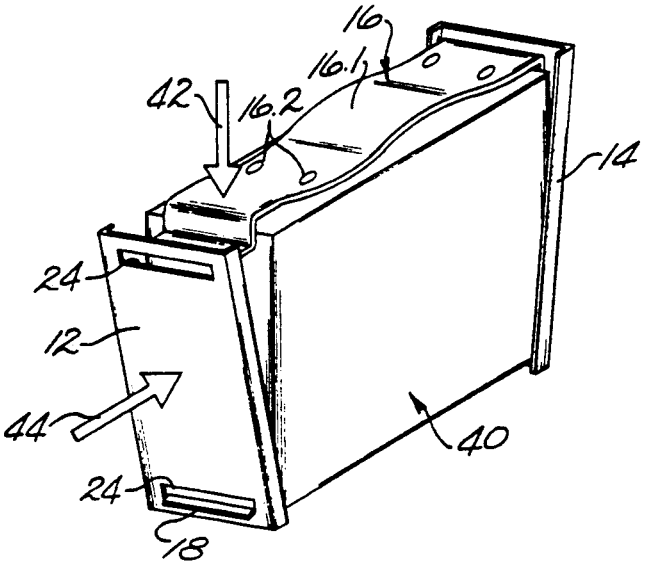
FIG. 5 is a perspective view illustrating assembly of components of the heater of FIG. 1.

Referring to the drawings, 10 in FIGS. 1–6 indicates a preferred embodiment of the novel and improved heater of the invention. The heater comprises a pair of housing members 12 and 14 and a pair of spring elements 16 and 18 which are secured together to form a housing unit 20 and to define an opening 22 extending through the housing unit. Preferably the housing members are formed of an electrically conductive metal material or the like such as aluminum, brass or steel and the housing members are preferably of shallow channel shape as shown in FIG. 5. Each housing member preferably has slots 24 formed in the respective opposite ends of the members, and one housing member is preferably blanked to form an integral terminal part 26 bent out of the general plane of the member and to provide an aperture 28 in the member. See FIG. 3. Preferably the spring elements 16 and 18 are formed of stiffly resilient material such as stainless steel, beryllium copper or phosphor bronze or the like, and preferably have wave spring portions 16.1, 18.1 provided with spaced, dimpled contact points 16.2, 18.2 or the like and hooked portions 16.3, 18.3 at either end bent oppositely from the wave portions to be detachably engaged in respective housing member slots.

A terminal plate 30 of electrically conductive material such as aluminum or steel, preferably having spaced, dimpled contact points 30.1 provided on opposite sides of the plate, is centrally disposed between the housing members with opposite ends of the plate extending in the direction of the housing members, one end 30.2 extending through the aperture 28 in housing member 14 to be accessible from an exterior part of the housing unit 20 along with integral terminal 26.

Fin means such as a plurality of fin members 32 are disposed within the housing unit 20, preferably in pairs at opposite sides of the terminal plate. Each fin member preferably comprises a pair of plates 32.1, 32.2 and baffle means 32.3 disposed between the fin member plates. As the heat-exchanging fin members 32 are of any conventional type within the scope of this invention, they are not further described herein with respect to FIGS. 1–5 and it will be understood that the baffle means comprises a plurality of baffle or louver portions 32.4 extending between the fin member plates to define a plurality of air or fluid flow passages or passage portions through the fin member between the baffle portions as indicated at 32.5, whereby air or other fluid passed through the housing opening 22 is passed through the passages 32.5 in the fin members in heat-transfer relation to the fin members. Preferably the fin members 32 comprise plates and baffle means formed of low cost aluminum or the like of high thermal and electrical conductivity properties. In a typical embodiment, the fin member plates are soldered or brazed or the like to the baffle means to form integrated fin members.

A plurality of self-regulating electrical resistance heater means such as the heater element or disc 34 are also disposed within the housing unit. Preferably each heater disc comprises a body 34.1 of a ceramic material of lanthanum-doped barium titanate or the like of positive temperature coefficient of resistivity (PTC) having electrical contact means 34.2 preferably formed with a rough metal surface on two opposite sides of the ceramic body by flame-spraying with aluminum or the like. As such self-regulating electrical resistance heater discs are well known, they are not further described herein and it will be understood that when the heater discs are electrically energized by directing electrical current through the body between the contacts, the body material is self-heated to provide a heat output and to progressively increase in temperature and resistance until the heater discs stabilize at a temperature at which the reduced heat generated by the increased resistance is balanced by the heat being dissipated or withdrawn from the discs through the fin members e.g. Preferably as shown particularly in FIG. 2, groups of the heater discs are disposed between the pairs of fin members at each side of the terminal plate 30. Preferably as shown, just two of the heater discs are arranged between each pair of the fin members. In an alternate embodiment, the heater discs are formed of a somewhat rigid organic PTC body material where the body material has sufficient rigidity to be shaped-retaining under pressure over a long service life.

Electrical insulator means such as the insulator strips 36 are arranged between the electrically conductive housing members 12 and 14 and those fin members immediately adjacent the terminal plate. Preferably the insulator strips also extend between the pairs of fin members 32 and around the heater discs 34 which are disposed between the fin members, the strip having lesser thickness than that of the heater discs and being arranged to avoid shorting between the adjacent fin members. Preferably a thermal grease such as a zinc oxide powder filled silicon grease or the like 38 is disposed between the heater disc contacts and the adjacent fin members, and preferably around the heater discs within holes 36.1 provided in the insulator strips. See FIG. 4.

In that arrangement, the fin members, heater discs, insulator strips and thermal grease are assembled in a stacked relation as shown with the edge of the stack as shown at 40 in FIG. 5 disposed within the channel shapes of the housing members 12 and 14 fitted over the ends of the fin members and insulator strips, the spring element 16 being detachably connected to one end of each of the housing members e.g. The second spring element 18 has one end fitted within a slot 24 in an opposite end of one housing member and is then pressed against the fin members at the top of the stack and snapped into a slot at the corresponding end of the other housing member as indicated by arrows 42, 44 in FIG. 5. In that way, the heater is provided with a snap-together construction. The spring elements 16 and 18 resiliently position the fin members and the heater discs in thermally and electrically conductive relation to each other and in electrically (and thermally) conductive relation to the terminal plate 30 and to the integral terminal 26 to be securely retained in the housing unit 20 and to define a circuit between the terminal plate and integral terminal for electrically energizing the heater discs. The housing members are also thermally connected to the fin members via the springs. Where there are only two of the heater discs disposed between adjacent pairs of the fin members as is preferred, the resilient bias force exerted by the spring elements is able to slightly tilt the fin members if necessary to assure that the fin members bear against each heater disc contact with substantially equal force throughout the heater. When an electrical current is furnished to the terminal plate 30 from a power source as indicated by line terminal 46 the current is directed in sequence through a fin member, a group of heater discs and another fin member to one of the spring elements at each side of the terminal plate. The circuit then extends to the housing member 18 to the integral terminal and the second line terminal 48 of opposite polarity.

Figure 1:
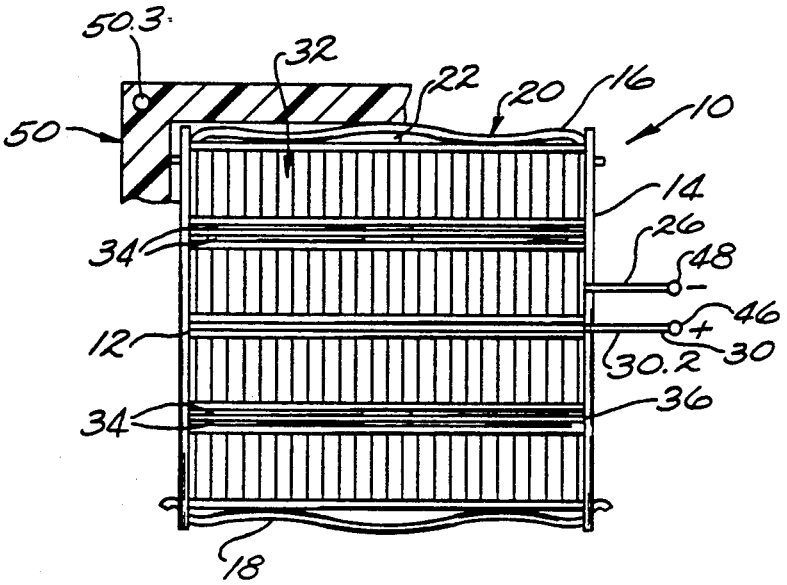
FIG. 1 is a front elevation view of a preferred embodiment of the heater of the invention.
Figure 2:
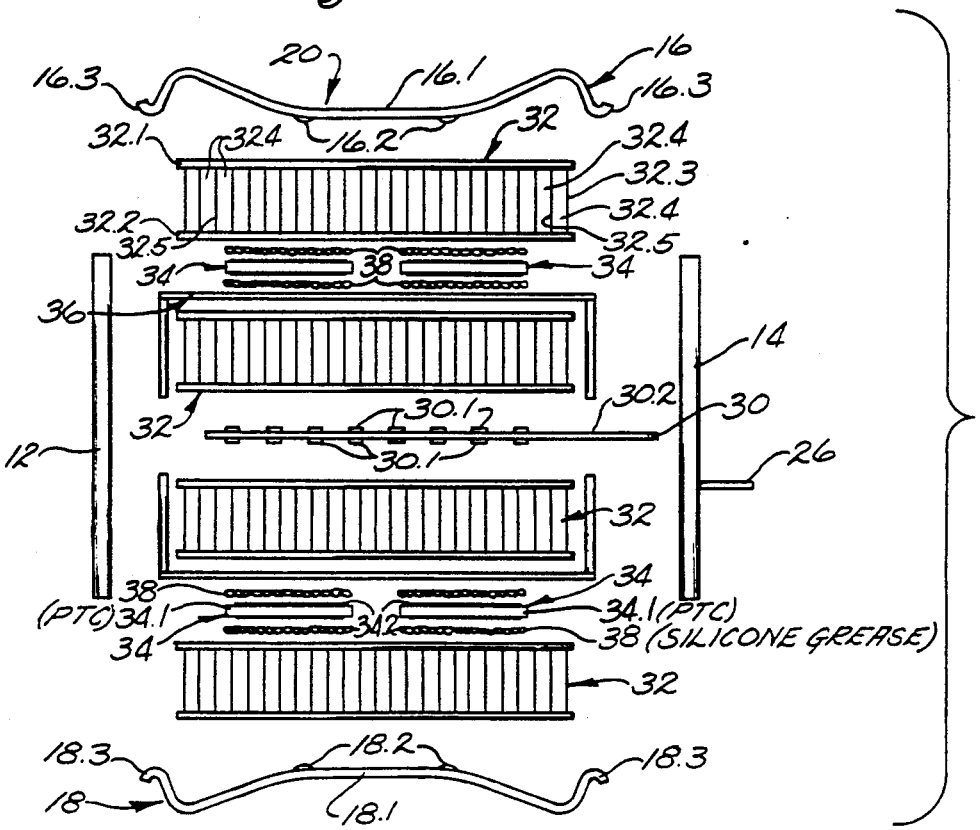
FIG. 2 is an exploded view of the components of the heater of FIG. 1.
Figure 3:
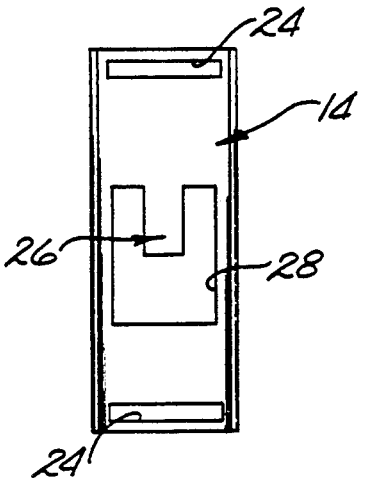
FIG. 3 is an end view of a housing component of the heater of FIG. 1 in a stage of manufacture.
Figure 4:
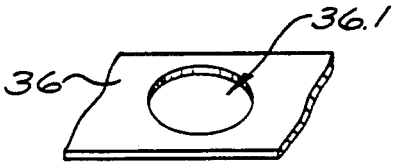
FIG. 4 is a partial perspective view of an insulator component of the heater of FIG. 1.
Figure 6:
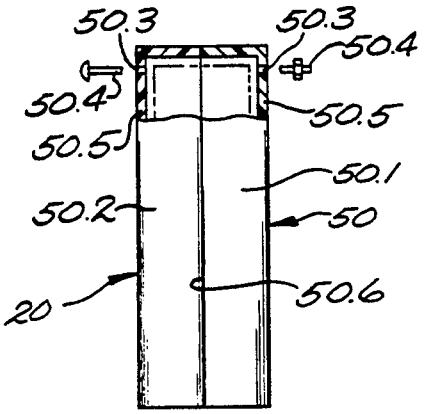
FIG. 6 is an end elevation view of another housing component of the heater of FIG. 1.

Preferably an outer housing enclosure component 50 of a thermally and electrically insulating material such as polycarbonate or the like is fitted around the housing unit 20 as indicated in FIGS. 1 and 6. Preferably, for example, the housing enclosure component comprises two enclosure halves 50.1, 50.2 having mounting bosses or apertures 50.3 to receive heater mounting bolts 50.4 and each having an opening 50.5 to cooperate with the housing members and spring elements as above described and defining the housing opening 22 extending through the heater housing means. The enclosure halves can be heat-sealed together or the like along edge 50.6 if desired.

In that arrangement, the heater 10 comprises parts which are each adapted for low cost manufacture, particularly in volume production, but which are each adapted for high efficiency in operation. The heater parts are easily assembled by a snap-together construction without requiring slow or expensive soldering, brazing or riveting operations or the like in the final assembly procedure.

In addition, the heater components are 100% reworkable if initially assembled in an improper manner of if individual components require replacing. There is also no need for oven curing operations or the like. Each of the heater parts is adapted to be securely retained in its desired operative position over a long service life. The heater discs are protected against tampering but are disposed for achieving maximum efficiency of heat-transfer to the fin means directly within the housing opening e.g. The baffle means incorporated in the heater are adapted to be formed of low cost, easily formed and thermally conductive aluminum with assurance that the spring means in the heater maintain the heater disc contacts in secure and reliable electrical contact pressure engagement with the fin member over a long service life even though the heater is subjected to heavy vibration in automotive vehicle applications, even though the heater parts are subjected to thermal expansion and contraction during the wide temperature swings to which such a heater is exposed in automotive applications, and even though aluminum materials selected for their low cost and high thermal conductivity tend to undergo some cold metal flow when subjected to high tensile or compressive force for a long period of time.

Figure 7:
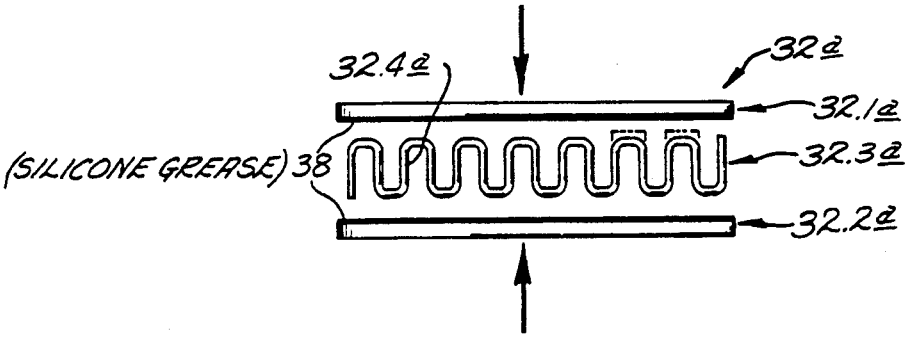
FIGS. 7 and 7A are enlarged partial views of a fin means used in other preferred embodiments of the heater of the invention.

In another preferred embodiment of the invention, heater cost is further reduced by using fin members comprising baffle means which are prepared free of soldering or brazing. For example, as shown in FIG. 7, each of the fin members 32 described above in the heater 10, is adapted to be replaced by the fin means 32*a* shown in FIG. 7 in which a pair of fin member plates 32.1*a*, 32.2*a* have a separate, discrete baffle member 32.3*a* disposed therebetween, the baffle member preferably being formed from a single strip or sheet of aluminum metal or the like having baffle or louver portions 32.4*a* of any desired configuration extending between the plates. When such fin members 32*a* are substituted in the heater 10 as described, the spring elements 16 and 18 further serve to hold the fin member plates and baffle members resiliently in thermally and electrically conductive engagement and to retain the fin members 32*a* in that assembled engagement within the heater throughout a long service life. If desired, a thermal grease as above described is disposed around the points of thermal and electrical engagement between the baffle member and plates adjacent those engagement points in thermally conducting relation to the member and plates to assure good heat-transfer therebetween. Alternately, if desired the baffle member 32.3*a* is formed from a single sheet of metal having integral fin plate portions provided in the baffle member by the selected sheet-forming configuration if desired, the fin plates then being omitted.

Figure 7A:
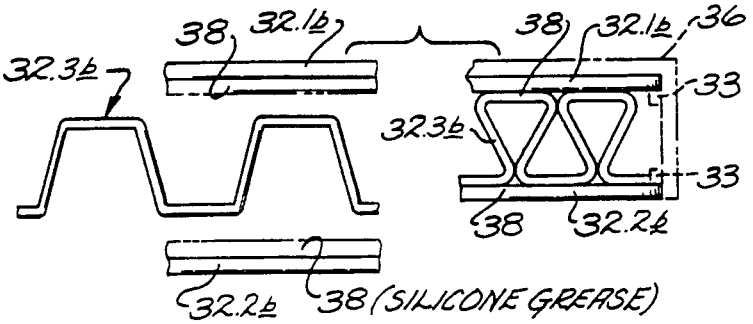

In another embodiment as shown in FIG. 7A, the baffle member 32.3*b* is easily formed in an open, accordion shape as indicated at the left side of FIG. 7A and is adapted to be compressed into the strong, rigid truss configuration shown at the right side of FIG. 7A as the housing components are filled together in their preferred snap-together construction as described above. Again, thermal grease as indicated at 38 in FIG. 7A is preferably disposed between plates and baffle portions which are thermally and electrically engaged with each other. If desired, turned in ends of the plates as indicated by border lines 33 in FIG. 7A can be used to assist in retaining the truss shape.

Figure 8:
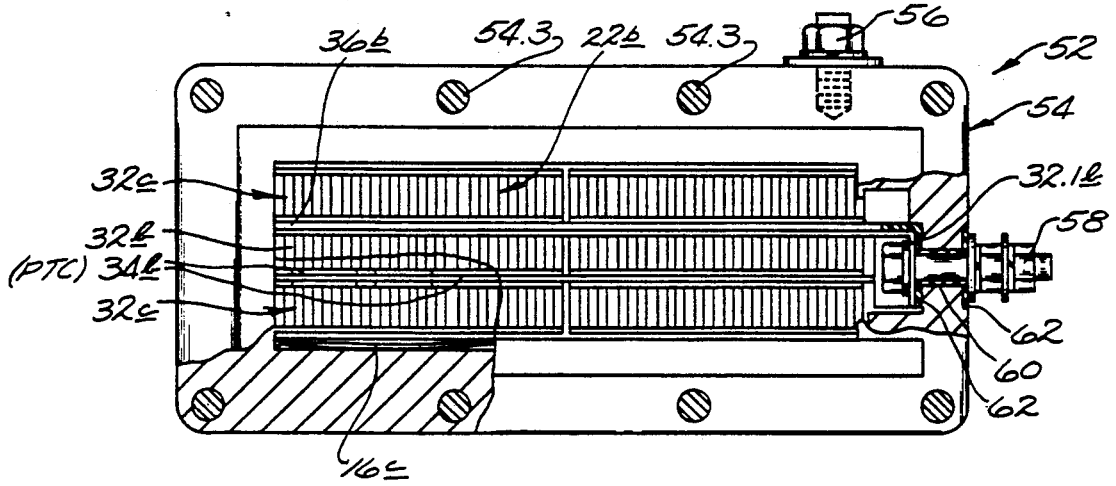
FIG. 8 is a front elevation view partially cut away of another preferred embodiment of the invention.
Figure 9:
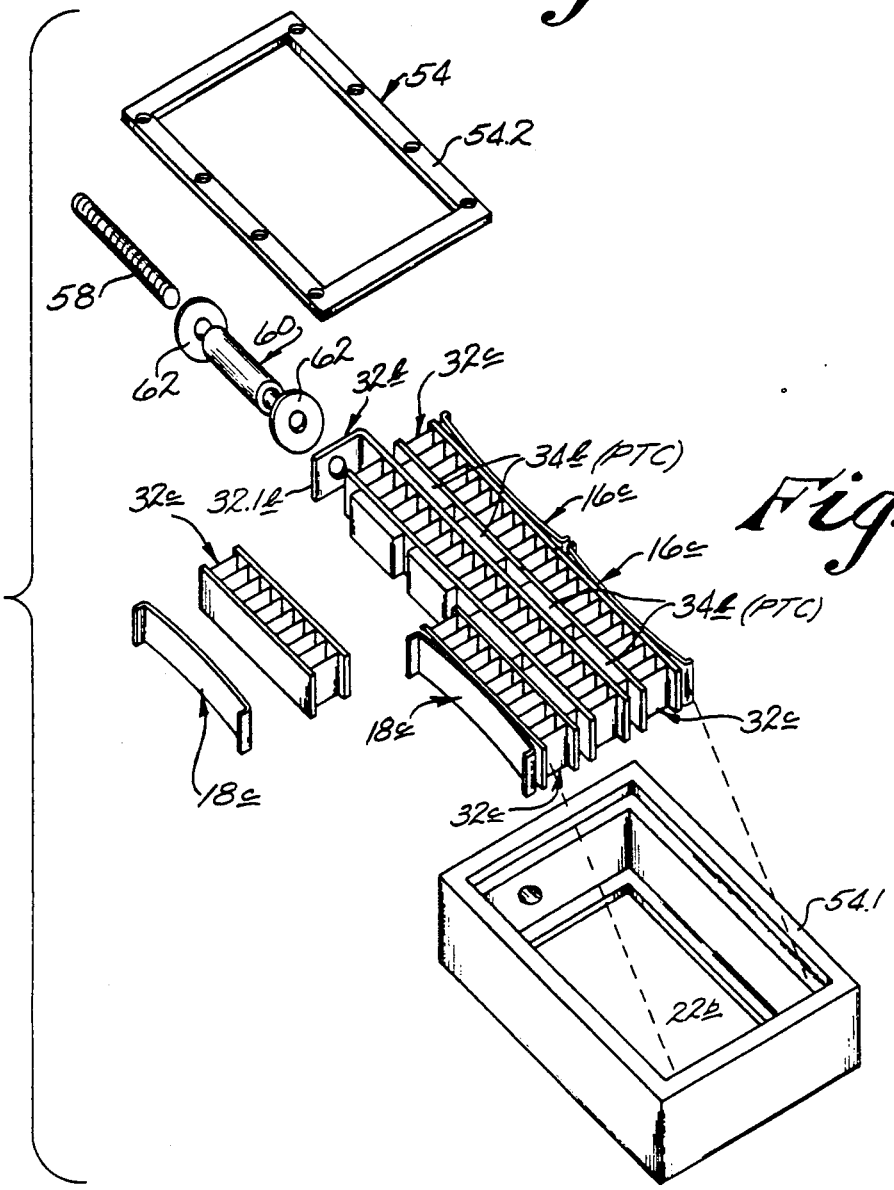
FIG. 9 is an exploded perspective view of components of the heater of FIG. 8.

In another preferred embodiment of the invention as shown at 52 in FIGS. 8–9, wherein corresponding parts are identified with corresponding reference numerals, a housing means comprising an electrically conductive housing enclosure component 54 is provided with an opening 22*b* extending through the housing means, the housing component preferably being formed of an open-topped box 54.1 having a bottom opening and of a cover 54.2 having a correspondingly sized opening, the cover being secured to the box with screw means 54.3 which may also be used to mount the heater 52 within an automobile. In this arrangement, a terminal bolt 56 serves to electrically connect the housing to electrical ground for example.

If desired, other means such as a lead attached to housing can be used for electrically connecting the housing to electrical ground. Within the housing a plurality of fin members 32*b*, 32*c* are arranged in a plurality of rows extending across the housing means opening. Preferably, for example, the fin member 32*b* is provided with a flange or mounting part 32*b*.1 and a second terminal bolt 58 extends through that flange and through the housing component 54 as shown in FIGS. 8–9 for securely mounting that fin member 32*b* to extend across the housing means opening. A sleeve 60 and two washers 62 of electrically insulating fiber board or the like serve to electrically isolate the terminal bolt 58 from the housing means. The fin members 32*c* are of relatively shorter length than the fin member 32*b* and are disposed along opposite sides of the fin member 32*b*, a pair of heater elements or discs 34*b* being disposed between each of the fin members 32*c* and a part of the larger adjacent fin member 32*b* in thermally and electrically conductive engagement with the fin members. Separate spring elements 16*b* and 18*b* each have a central wave portion and a pair of mounting feet at opposite ends, are disposed in resilient engagement the respective fin members 32*c* and bear with a reaction force against the housing enclosure to firmly position the fin members and heater discs in the heater 52 and to reliably retain the heater discs, fin members and spring elements in a desired circuit between the terminals 56, 58. Preferably insulator strips 36*b* (not shown in FIG. 9) are disposed between adjacent fin members around the heater discs. This arrangement provides a particularly rugged heater structure adapted to be located in a diesel engine intake air line or the like for preheating diesel intake air passed through the housing opening through fluid flow passage portions in the fin members in heat-transfer relation to the fin members. It has been suggested that such preheating of the diesel intake air not only at motor start-up but also during running operation of the motor is adapted to reduce "white smoke" type of pollution emissions from diesel engines and this heater construction 52 is particularly adapted to serve that purpose even in off-road vehicles or construction vehicles and the like.

Figure 10:
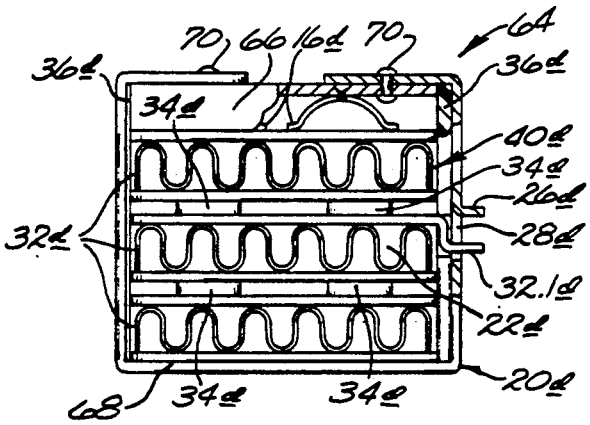
FIG. 10 is a front elevation view partially cut away of another preferred embodiment of the invention.

In another preferred embodiment of the invention as shown at 64 in FIG. 10, a three row stack 40*d* of fin members 32*d* having pairs of heater discs 34*d* disposed between adjacent pairs of the fin members, has a pair of spring elements 16*d* welded or otherwise secured to a spring support member 66 to bear against one side of the noted stack. A strap member 68 of electrically conductive metal or the like such as brass, steel or aluminum extends around the perimeter on the other three sides of the stack and is secured to the spring support by screws or rivets 70 or the like to compress the spring elements 16*d* against the stack, the strip and the spring support cooperating to form the heater housing means unit 20*d* and to define the housing means opening 22*d*. Electrical insulator strips 36*d* or the like are arranged between the housing strap and the fin member ends as shown and may also extend between the fin members around the heater discs if desired. The housing strap is preferably formed with an opening 28*d* and has an integral terminal part 26*d* located at that opening. The central fin member in the stack also has an integral terminal part 32*d*.1 which extends through the housing member strap opening 28*d* to a location exteriorly of the housing.

Figure 11:
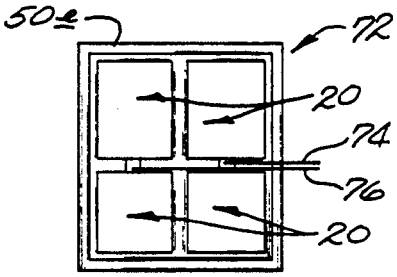
FIG. 11 is a diagrammatic front elevation view of another preferred embodiment of the invention.
Figure 12:
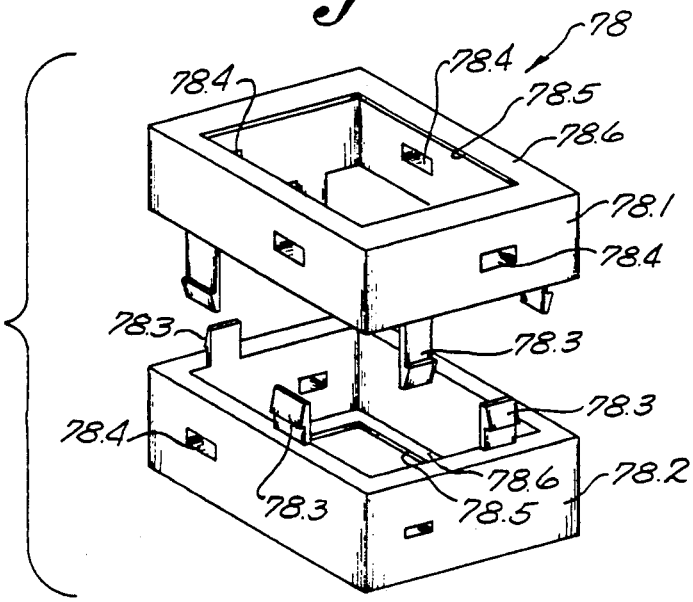
FIG. 12 is a perspective view of an alternate housing component structure.

In another preferred embodiment of the invention at 72 in FIG. 11, a plurality of the housing units 20 as described above with reference to FIG. 1 are assembled within a larger heater enclosure component 50*e* and leads 74 and 76 respectively connect the terminal plates and the integral terminal of those housing units 20 for electrically connecting the housing units 20 in parallel relation to each other.

In another preferred embodiment of the invention, the heater unit 20 for example is disposed in a housing component 78 having identical cup-shaped halves 78.1, 78.2 each having four detents or tangs extending from a cup edge in the form of snap-fingers with outwardly facing barbed ends 78.3 and with corresponding slots 78.4 in side walls of the cup-shapes, the housing halves each having an opening 78.5 and a shoulder 78.6 around the opening. These housing unit halves are adapted to accommodate the housing unit 20 therebetween and to be snapped together around the rivet by pushing the halves together until the detent backs snap into corresponding slots. The tapers on the outer surfaces of the barbs engage the rim of the opposite housing half to be pressed inwardly until, as the halves are pushed together, they snap into the corresponding slot to detachably secure the halves together into the shoulders and cup-shapes positioning the unit 20 in a desired alignment with the housing openings to pass air through the unit.

It should be understood that although particular embodiments of the heater of the invention have been described by way of illustrating the invention, many modifications of the number and arrangement of fin members, heater discs, terminals and springs are possible within the scope of this invention and the invention includes all modifications and equivalents of the disclosed embodiments falling within the scope of the appended claims.

We claim:

1. An automotive passenger compartment heater comprising a housing unit having a pair of housing members disposed in spaced relation to each other at opposite sides of an opening extending through the housing unit; said housing members having slots therein adjacent respective opposite ends thereof, a pair of electrically conductive terminal means accessible from an exterior part of the housing unit and extending therein, a plurality of electrically conductive heat-exchanging fin means in electrical conductive relation to said terminal means disposed in the housing unit defining a plurality of fluid flow passage portions extending through the fin means for passing fluid through the housing unit opening through the fin means in heat-transfer relation to the fin means for heating the fluid, and self-regulating electrical resistance heater means having at least one body of ceramic material of positive temperature coefficient of resistivity with electrical contact means on two opposite sides thereof disposed in the housing unit between one pair of immediately adjacent fine means, thermally conducting grease disposed between the heater means and the immediately adjacent fin means for enhancing heat-transfer from the at least one body of the heater means to the fin means, spring means detachably mounted in the slots and extending between the pair of housing members at opposite end thereof for forming said housing unit, said spring means resiliently positioning the fin means, terminal means and the at least one body of the heater means with grease in thermally and electrically conductive engagement to be retained in the housing means and to define an electrical circuit electrically connecting the terminal means through the adjacent fin means and the at least one body of the heater means in sequence for electrically energizing the at least one body of the heater means to provide heat to the fin means for heating the fluid.

2. A heater according to claim 1 wherein the fin means each comprise a pair of plates and a separate baffle member disposed between the plates, the baffle member having a plurality of baffle portions extending between the plates for defining the plurality of fluid flow passage portions between the baffle portions extending through the means, the spring means resiliently biasing the pair of plates into thermally and electrically conductive engagement with the baffle member to be retained in the housing unit and to define a portion of said circuit extending through the fin means between the plates.

3. A heater according to claim 1 wherein said at least one body of ceramic material is a plurality of bodies and one side of an immediately adjacent fin means engages contact means on one side of said plurality of ceramic material bodies and the spring means resiliently biases that fin means side to engage the contact means on said one side of said plurality of ceramic material bodies with substantially equal force.

4. An automotive passenger compartment heater according to claim 1 having a thermally insulating housing enclosure surrounding the housing members and spring means and cooperating with the housing members in defining the housing unit opening.

5. An automotive passenger compartment heater according to claim 1 wherein at least one of the housing members is electrically conductive, has an integral portion thereof forming one of said terminal means, and the spring means is electrically conductive and disposed in resilient electrical engagement with the immediately adjacent fin means and said one housing member.

6. An automotive passenger compartment heater according to claim 1 wherein said heater means comprises groups of two such ceramic heater bodies which are disposed between immediately adjacent pairs of the fin means, at least one of the fin means in said pair has one side thereof engaging contact means on one side of said two heater bodies disposed between said pair of fin means, and the spring means resiliently biases that fin means side to engage said contact means on the two heater bodies with substantially equal force.

* * * * *